United States Patent [19]

Yang

[11] Patent Number: 4,727,782

[45] Date of Patent: Mar. 1, 1988

[54] SOCKET WRENCH AND SOCKET MEMBERS THEREFOR

[76] Inventor: Tai-Her Yang, 5-1 Taipin St., Si-Hu Town, Dzan-Hwa, Taiwan

[21] Appl. No.: 896,270

[22] Filed: Aug. 14, 1986

[51] Int. Cl.[4] ..... B25B 13/02

[52] U.S. Cl. ..... 81/124.4; 81/125.1; 81/177.4

[58] Field of Search ..... 81/124.4, 125.1, 177.4, 81/490

[56] References Cited

U.S. PATENT DOCUMENTS

| | | | |
|---|---|---|---|
| 1,424,676 | 8/1922 | Parsons | 81/125.1 |
| 2,466,884 | 4/1949 | English et al. | 81/125.1 |
| 3,745,860 | 7/1973 | Bennett | 81/124.4 |
| 4,302,990 | 12/1981 | Chrichton et al. | 81/177.4 |

*Primary Examiner*—Frederick R. Schmidt
*Assistant Examiner*—Judy J. Hartman
*Attorney, Agent, or Firm*—Leonard Bloom

[57] ABSTRACT

A wrench has a slotted handle for receiving the respective socket members therein. The handle also has at least one window formed therein. The socket members are sized so as to be keyed when disposed in the handle, to prevent lateral and rotational movement therein. The socket members are also provided with a detent engaging member. A detent, carried by the handle engages the detent engaging member so that the socket members so engaged are removably retained in the handle with the socket bore of the endmost positioned member being substantially aligned with the window of the handle.

1 Claim, 14 Drawing Figures

SOCKET WRENCH AND SOCKET MEMBERS THEREFOR

FIELD OF THE INVENTION

The present invention relates to socket wrenches and socket members therefor and, more particularly, to a socket wrench which carries a plurality of socket members in the handle thereof, any one of which may be selected for use therewith.

BACKGROUND OF THE INVENTION

Traditional socket wrenches of which I am aware are of the type having a grip handle which have either a fixed socket at one or both ends or which has a fixed, socket-engaging shank at one end. The former case requires the provision of a number of wrenches to make a complete set. The latter case requires the provision of a number of varying loose socket elements which are difficult to use and are readily susceptible to being lost. In addition, both cases require fabrication of a separate storage box for storing the plurality of sockets and/or wrenches therein, thereby increasing costs and requiring excess storage space within a tool box.

Thus, it will be appreciated that there remains a need for multiple socket socket wrench which possess a handle for storing the sockets therein.

SUMMARY OF THE INVENTION

Accordingly, it is the primary objective of the present invention to alleviate the disadvantages and deficiencies of the prior art by providing a multiple socket socket wrench having a handle for storing of the sockets therein.

In accordance with the teachings of the present invention, a wrench is disclosed. This wrench has at least one socket member. Each respective socket member has a socket bore formed therein and further has a detent engaging means thereon. A slotted handle is provided for receiving respective socket members therein, wherein said socket members are keyed in the handle preventing lateral and rotational movement of the socket member in the handle. Said handle further has a window formed therein. Finally, a detent means provides for engaging the detent engaging means of the socket member, so that the socket member is removably retained in the handle with the socket bore thereof being substantially aligned with the window of the handle.

In further accordance with the teachings of the present invention, a socket wrench is disclosed. This socket wrench has an elongated tubular handle being substantially rectangular in cross-section and having respective open ends. A plurality of sockets are provided, each having a bore formed therein. Each socket is substantially rectangular in cross-section, wherein each of said sockets is slidably received in and keyed to the handle, and further wherein each of the sockets may be received in one end of the handle and slidably moved through the handle and removed therefrom through the other opposite end of the handle. Said handle further has at least one window formed therein. Said window is of a size that is larger than the diameter of the bore of the sockets. Also, detent retaining means are positioned at both ends of the handle for cooperating with the socket to removably retain the socket within the handle, so that the bore of the socket is substantially aligned with the window of the handle.

Preferably, each of the bores formed in the sockets is of a polygonal shape and each bore is of varying size. In one embodiment, the handle is provided having a window formed therein substantially near both respective open ends thereof. In another embodiment, each of the sockets has a respective notch formed therein and the detent retaining means is a respective resilient, inwardly-biased, spring-clip member that cooperates with the said notch of the socket. In still another embodiment, each of the sockets has a respective notch formed therein and the detent retaining means is a respective resilient, inwardly-biased, ball-spring detent that cooperates with the said notch of the socket. In still yet another embodiment, each of the sockets has a notch formed therein on a respective pair of diametrically opposite faces thereof, and the detent retaining means at the respective ends of the handle are a pair of resiliently-biased spring-clip members that are positioned on diametrically opposite walls within the handle, each member being so positioned to cooperate with a respective notch of the socket. And in another embodiment, each of the sockets has a perspective notch formed therein on a respective pair of diametrically opposite faces thereof, and the detent retaining means of the respective ends of the handle are a pair of resilient, inwardly-biased, ball-spring detents that are positioned on diametrically opposite walls within the handle, each member being so positioned to cooperate with a respective notch of the socket.

In still further accordance with the teachings of the present invention, another socket wrench is disclosed. This socket wrench has at least two socket members. Each of said members has a socket bore formed therein. Each of said members further has at least one notch formed therein. A substantially hollow handle is provided having opposite open ends, whereby a channel is defined therethrough. Said channel is of a size to snugly and slidably receive the socket members therein. Said handle further has an aperture formed therein. At least two spring-loaded detent means are carried within the handle. Each detent means is in communication with the channel. Said detent means are resiliently-biased in an inward direction and have a first unseated position. Each also has a second seated position wherein said detent is seated in the notch of one of said socket members, thereby securing said socket member. In this manner, the socket bore thereof is substantially aligned with the aperture in the handle, and additional longitudinal movement of the socket within the handle is prevented. Said handle further is of a longitudinal length, wherein positioning of the socket members within the handle results in the notch of the respective endmost socket members located therein engaging respective detent means in their second seated position.

And in still yet further accordance with the teachings of the present invention, still another socket wrench is disclosed. This socket wrench has at least two socket members. Each of said members has a socket bore formed therein. Each of said members further has at least one notch formed therein. A handle is provided having bottom wall. A pair of inwardly extending flanges are positioned on a substantially identical horizontal plane. Said flanges are further positioned on a plane being substantially parallel to the bottom wall. A pair of upwardly extending respective parallel side walls are provided. Each is integrally formed with a respective said side wall and a respective said flange, whereby a handle with two open ends is formed. Said bottom wall further has a window formed therein. At least two spring-loaded detent means are carried within the handle. Each is in communication with the channel. Said detent means are resiliently-biased in an inward direction. Said detent means has a first unseated position. Each detent means also has a second seated position, wherein said detent is seated in the notch of one of said socket members, thereby securing said socket member. In this manner the socket bore thereof is substantially aligned with the aperture in the handle, and further additional longitudinal movement of the socket within the handle is prevented. Said handle further is of a longitudinal length wherein positioning of the socket members within the handle results in the notch of the respective endmost socket members located therein engaging respective detent means in their second seated position.

DESCRIPTION OF THE PREFERRED EMBODIMENTS

Figure 1:
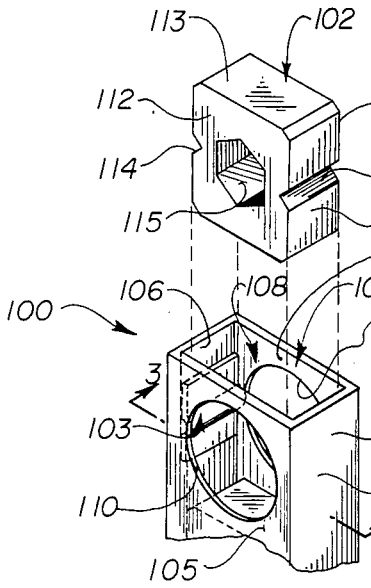
FIG. 1 is a partial perspective view of a respective end of the socket wrench having a socket removed therefrom for the sake of clarity.

Referring now to the drawings, in FIGS. 1, 2, 3 and 4 there is illustrated a preferred embodiment of the wrench 100 of the present invention. As illustrated, said wrench 100 is generally comprised of a wrench handle 101, at least two separate socket members 102 and socket engaging means 103.

As illustrated, the body of the wrench handle 101 is elongated (tubular) being substantially rectangular in shape and in cross-section. Said handle 101 is hollow having a top wall 104 and a bottom wall 105. A pair of parallel side walls 106 are positioned between and ar integral with said top wall 104 and said bottom wall 105. Said handle 101 is further formed having open ends 107 being oppositely positioned to one another, whereby a substantially closed channel (slot) 108 is defined extending longitudinally through the handle 101. As described above, said channel 108 is substantially rectangular in cross-section.

The top wall 104 is further provided having a pair of apertures (windows) 109 formed therein, each of said apertured 109 being positioned on ends of the top wall 104 opposite from one another near the open ends 107. In an identical fashion, the bottom wall 105 is also provided with a pair of apertures 110 formed therein. Each of said apertures 110 is so formed so as to be substantially aligned with a respective aperture 109 formed in the top wall 104, as aforesaid.

The socket members 102 of the present invention are substantially rectangular in shape and in cross-section. Each of said sockets 102 is sized so as to be snugly and slidably received within the closed channel (slot) 108 for longitudinal movement therein. Shaped thusly, each of said sockets 102 has a top face 111 and a bottom face 112 and four side faces 113 formed about the periphery of the socket 102 between the said top 111 and bottom 112 faces. Each of said sockets 102 has a notch (detent engaging means) 114 formed therein. As illustrated notches 114 are formed in two opposing side faces 113. Each of said notches 114 are formed on said faces 113 in a direction extending from the top face 111 to the bottom face 112 of said socket 102. The socket 102 is positioned within the channel 108, so that said side walls 113 having notches 114 formed therein face the side walls 106 of the handle 101.

Finally, a bore 115 is formed through each socket 102 extending laterally from the top face 111 to the bottom face 112, thus formed. Each of said bores 115 is preferably geometrically shaped, in the form of a polygonal, whereby a socket is formed. Preferably, each of said bores 115 is further formed being of a different size than the other bores, wherein sockets of varying sizes are defined.

The detent means (detent retaining means) 103 are positioned on of the side walls 106 of the handle 101 so as to extend inwardly towards the closed channel 108. Said means 103 are resiliently-biased inwardly in a direction towards channel 108. Preferably, a respective detent means 103 is positioned on each of the side walls 106. Said means 103 has a first unseated position, wherein said means is engaging the side wall 106. Said means 103 also has a second seated position, wherein said detent 103 is seated in the notch 114 of one of said socket members 102. Positioned, and resiliently-biased thusly, said means engage (cooperate with) a respective notch 114 on the socket 102 securing said socket in place. Means 103 are further positioned so that when engaging the notches 114 of each of the endmost sockets, the bores 115 of said sockets are substantially aligned with respective apertures 109 and 110 positioned at either end of the handle 102, whereby the element being tightened or removed may be received through the bottom wall 105, bores 115 and top wall 104 respectively. The cooperation between the notches 114 and means 103 further prevents undesired additional longitudinal movement of the socket 102 within the handle 101.

The socket engaging means 103 may be comprised of a pair of spring clip members 116 (FIG. 3), or a pair of spring-loaded ball detents 117 (FIG. 4) or any other suitable means.

Figure 3:
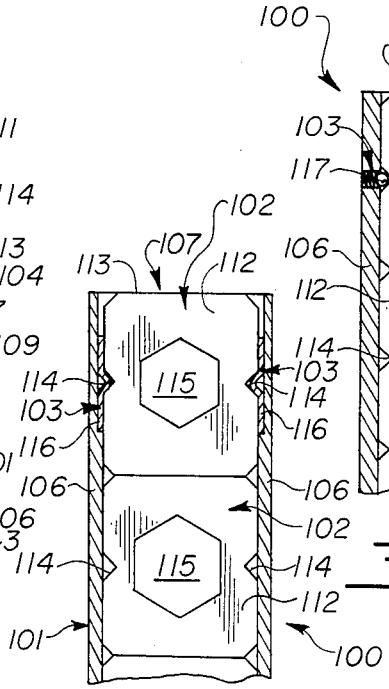
FIG. 3 is a partial top plan view, in cross-section, taken along lines 3—3 of FIG. 1, of a respective end of the socket wrench illustrating one embodiment of the means for retaining the sockets within the handle.
Figure 4:
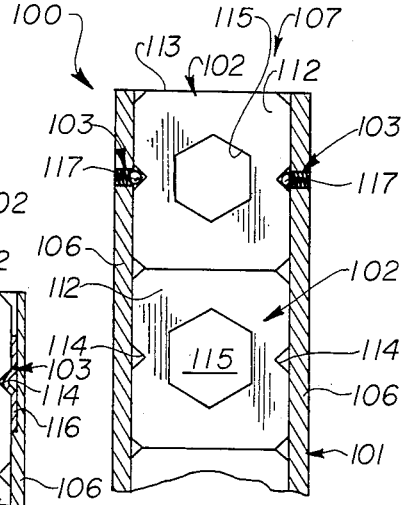
FIG. 4 is a partial top plan view, in cross-section, of a respective end of the socket wrench illustrating another embodiment of the means for retaining the sockets within the handle.
Figure 2:
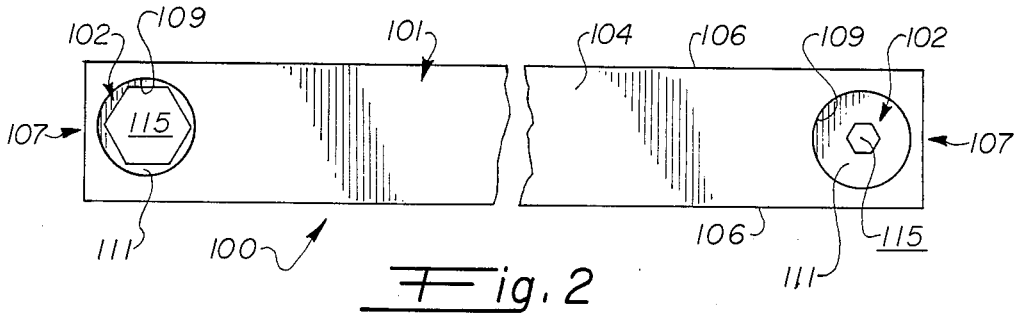
FIG. 2 is a top plan view of the socket wrench of the present invention.

In use, the various socket members 102 are disposed within the hollow interior of the handle body 101 with the notches 114 oriented in the direction of the side walls 106 and the bore 115 oriented in the direction of the top 104 and bottom 105 walls. Disposed thusly, the socket members 102 are positioned in abutting relationship to one another with an unnotched side face 113 of each socket member 102 abutting an unnotched side face 113 of an adjacent sockets member 102 (FIGS. 3 and 4). The socket members 102 are thereby keyed in the handle preventing lateral and rotational movement of said sockets 102 in said handle 101. When all the socket members 102 are thus disposed in the channel 108, the socket bore 115 of each of the endmost socket members 102 are each substantially aligned with respective apertures 109 and 110. Each of the socket members 102 is retained within the interior of the channel 108 by a respective detent means 103 engaging, cooperating with and being seated within, a respective notch (detent engaging means) 114.

When the user desires to change the socket being utilized he or she must merely manually remove either of the socket members 102 which are positioned immediately adjacent to either of the open ends 107. This force will overcome the resilient-biasing force of the socket engaging means 103, thereby unseating from the respective notch 114 of said socket member 102 each of the means 103. The socket 102 is then removed completely from the handle 101. However, due to the biasing action of the means 103 engaging either the notch 114 (when in its second seated position) or the side face 113 (when in its first unseated position), of the next positioned socket 102, said socket 102 (and all other sockets 102 disposed therein) are prevented from further longitudinal sliding movement within the handle 101. The user then manually inserts the socket 102 first removed from the one end 107 of channel 108 through the other opposite open end 107. Such insertion produces a force which overcomes the resilient biasing action of members 103 causing the means 103 to engage and slide over the flat side face 113 of the sockets 102 having the notches 114 formed therein, until still further movement results in said means 103 engaging the notches 114 thereof. When said means 103 engages the notches 114, the resilient biasing action of the means 103, moves said means 103 into a seated position within a respective notch 114, thereby securing the socket 102 in place. Positioned thusly, the wrench is now ready for further use.

In this manner, it can be seen that the handle is formed so that socket members 102 may be received in one end of the handle, slidably moved through said handle 101 and removed therefrom through the other opposite end.

Figure 5:
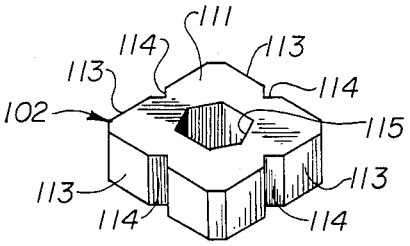
FIG. 5 is a perspective view of one embodiment of the sockets of the present invention.

It is to be understood by those skilled in the art that while thus described having a notch 114 formed in two opposite side faces 113, each socket member 102 may also alternatively be formed having a notch 114 found in each (all four) of the side faces 113, (FIG. 5) or only one side face 113 if so desired.

Figure 6:
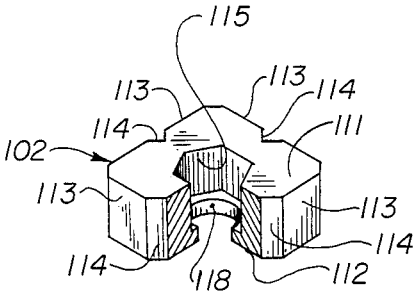
FIG. 6 is another perspective view of the socket of FIG. 5, having a portion thereof, broken away for the sake of clarity.

It is also to be understood by those skilled in the art that, if desired, the bottom face 112 of each socket member 102 may also be provided with an annular flange 118 formed about the periphery of the bore 115, whereby the element being tightened or being removed by use of the wrench 100 may not extend entirely through said bore 115 but, rather, abuts the said flange 118 (FIG. 6).

Figure 8:
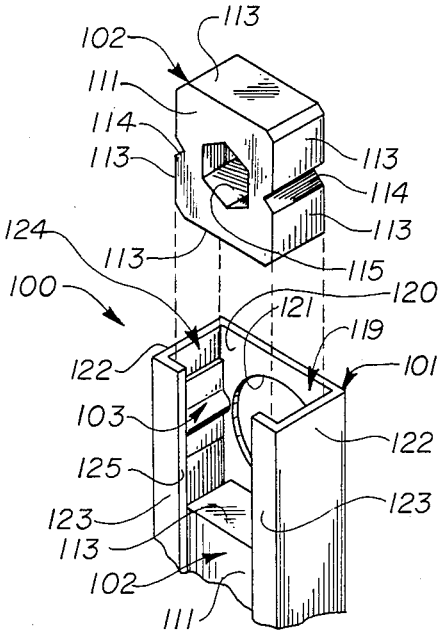
FIG. 8 is a partial perspective view of a respective end of the socket wrench of FIG. 7 having a socket removed therefrom for the sake of clarity.
Figure 7:
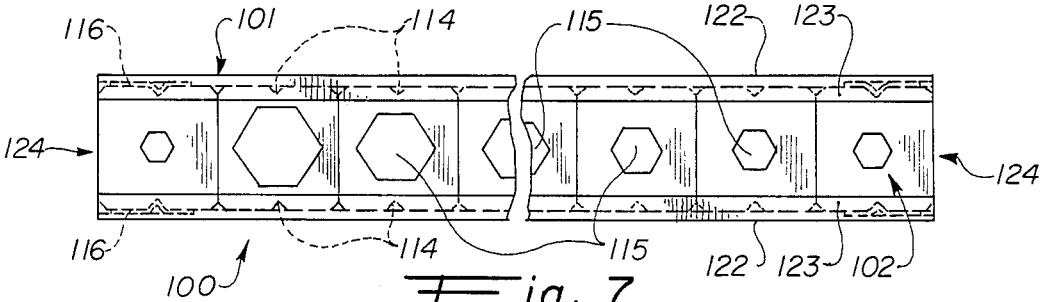
FIG. 7 is a top plan view, of another embodiment of the socket wrench of the present invention.

It is still further to be understood by those skilled in the art that, if desired, the handle 101 of the wrench 100 may alternatively be formed as a wrench having an open channel 119 (FIGS. 7 and 8). Said wrench has a bottom wall 120. Said bottom wall 120 has a pair of apertures (windows) 121 formed therein at opposite ends thereof. Upwardly extending parallel side walls 122 are provided, each being integral with the bottom wall 120. Respective, inwardly-extending flanges 123, each positioned on a substantially identical plane are integrally formed with a respective side walls 122. Said flanges 123 are further positioned on a plane being substantially parallel to the bottom wall 120. Formed thusly, a handle with two open ends 124 is formed. Also, a slot 125 is defined along the longitudinal length of the wrench between the two flanges 123. Said slot 125 also defines an open channel within the body of the handle.

In this embodiment, the top walls and its associated apertures are omitted entirely.

Figure 9:
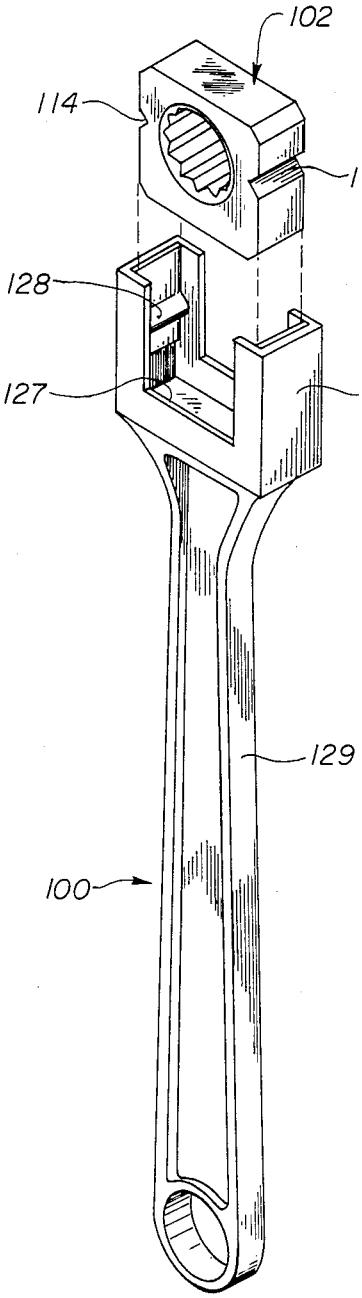
FIG. 9 is a perspective view of another embodiment of the socket wrench of the present invention having the socket removed therefrom for sake the of clarity.
Figure 10:
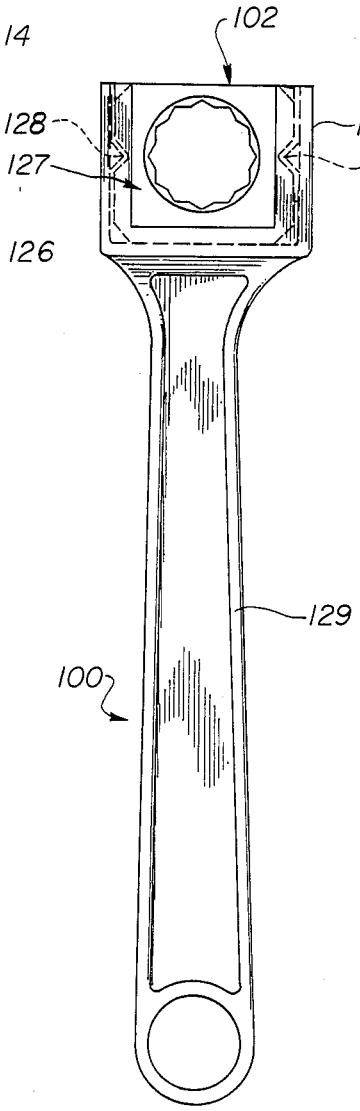
FIG. 10 is a front view of the socket wrench of FIG. 9.
Figure 11:
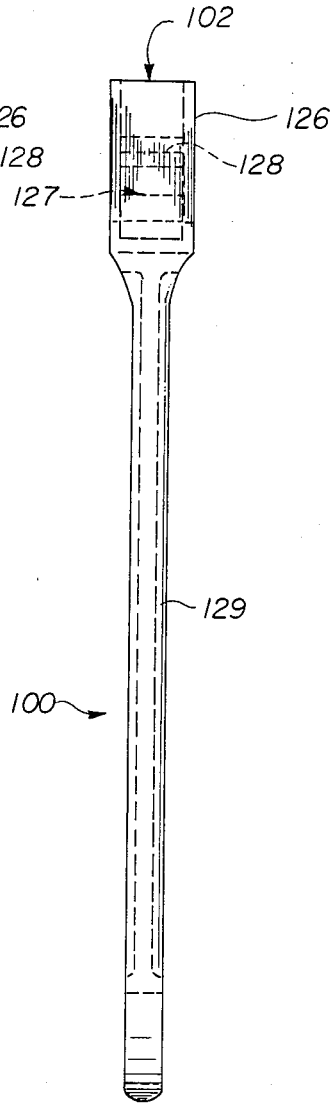
FIG. 11 is a side view of the modified socket wrench of FIG. 9.

With reference now to FIGS. 9, 10 and 11 the wrench 100 has a first end 126 having a short single socket slot channel (window) 127 with an open end formed therein. A pair of detent means 128 are positioned within said channel 127 to engage the respective notches (detent engaging means) 114 of the sockets 102 and to retain them therein. The second opposite end of said wrench 100 is provided with a gripping handle 129, whereby the wrench may be gripped so that torque may be applied, etc. The sockets 102 described above may be inserted into, and removed from, the wrench 100 through the single open end by manual force which overcomes the biasing action of the detent means 128 in the same manner as was described earlier with reference to FIGS. 1–4.

Figure 12:
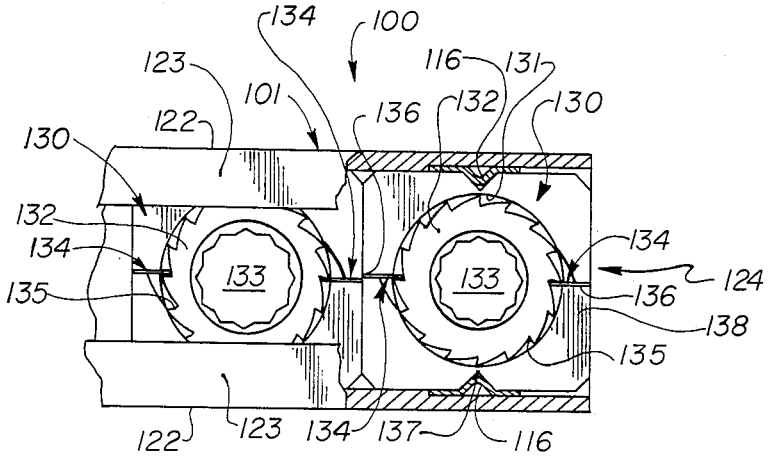
FIG. 12 is a partial, top-plan view, with parts broken away, of a respective end of the socket wrench of FIG. 7 having the socket thereof modified as a ratchet wrench.
Figure 13:
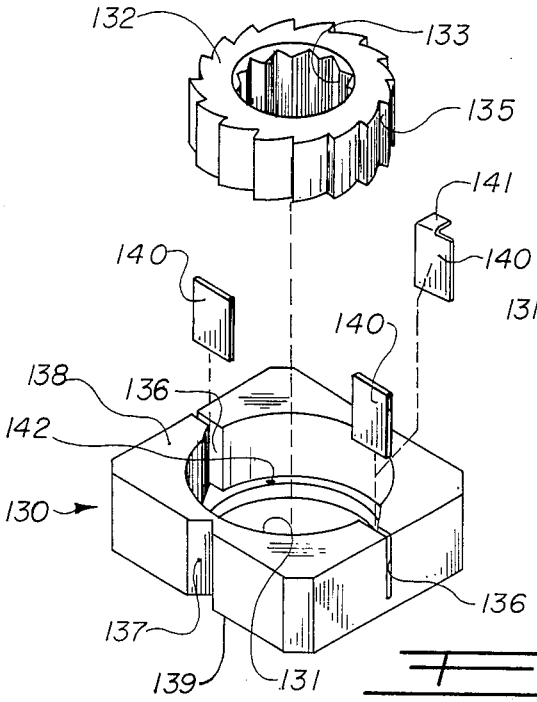
FIG. 13 is an exploded perspective view of the ratchet of FIG. 12.
Figure 14:
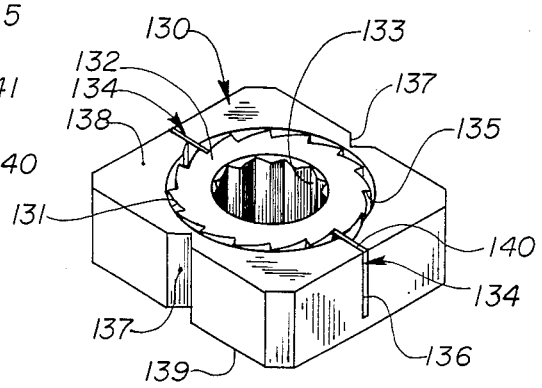
FIG. 14 is a perspective view of the ratchet of FIG. 12.

Finally, if so desired, each of the sockets may also be formed so as to be ratchets elements 130 (FIGS. 12, 13 and 14). In such an instance, the bore 131 of each ratchet element 130 is formed so as to be substantially circular in shape. Positioned within the bore 131 is a ratchet wheel 132 having a centrally positioned aperture 133 formed therethrough. Said aperture 133 is formed having any desired internal geometric (polygonal) shape, whereby a socket bore is defined. Pawls 134 are provided. Preferably, two such pawls 134 are diametrically positioned about the bore 131 for engaging the teeth 135 of the ratchet wheel 132. Said pawls 134 are, preferably, comprised of vertically oriented slots 136 being formed in the body of the sockets having a longitudinal axis being substantially parallel to those of the notches 137. Said slots 136 extend downwardly from the top face 138 of the element 130 terminating short of the bottom face 139 of the ratchet element 130. Said pawls 134 are further comprised of a pawl plate 140 which is received within each slot 136. Positioned thusly, pawl plates 140 engage the ratchet teeth 135, thereby preventing undesired rotational movement of the ratchet wheel 132 within the bore 131. If desired, the pawl plate 140 may also have a horizontally extending flange 141 formed integral therewith (FIG. 13). Finally, if desired the bottom face 139 of said ratchet element 130 may be formed having an annular flange 142 formed about the periphery of the bore 131, whereby the ratchet wheel 132 is restrained within the bore 131. This ratchet element, as thus illustrated and described is readily usable as a socket member in the socket wrenches described above and as seen in FIG. 12.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wrench and socket combination, comprising a handle having at least one open end, the handle being of tubular construction and having a longitudinal through bore formed therein, the bore having a rectangular cross-section, the handle further having a pair of parallel side walls, each of which has a relieved portion adjacent to the open end of the handle, thereby forming a shoulder in each of the parallel side walls of the handle, a relatively flat spring clip secured within each of the relieved portions, respectively, and bottoming on the shoulder in the respective side wall, each of the spring clips having an inwardly-directed projection formed intermediately thereof, a plurality of sockets received in the bore of the tubular handle, the sockets being disposed adjacent to each other, each of the sockets having a substantially identical plan outline, such that the sockets are keyed to the handle, thereby preventing substantial rotation of the sockets within the handle, each of the sockets further having four side walls, each of the side walls having a notch formed therein for cooperation with a respective one of the spring clips in the handle, such that the respective sockets may be inserted into the handle without regard to the orientation of the sockets therein, and such that the plurality of sockets is retained in the tubular handle, each of the sockets having a polygonal socket bore formed therein, the respective socket bores being of different sizes, the handle having a further pair of parallel walls intermediate the side walls thereof, and at least one of the further pair of walls having a window formed therein, such that the window provides accessibility to the polygonal socket bore in the respective socket which is retained by the respective spring clips adjacent to the open end of the handle.

* * * * *